US005366653A

United States Patent [19]

Corring

[11] Patent Number: 5,366,653

[45] Date of Patent: Nov. 22, 1994

[54] PROCESS FOR PREPARING CONCENTRATED DETERGENT COMPOSITIONS FOR USE IN AUTOMATIC DISHWASHERS

[75] Inventor: Robert J. Corring, Rockaway Township, N.J.

[73] Assignee: Lever Brothers Company, Division of Conopco, Inc., New York, N.Y.

[21] Appl. No.: 60,630

[22] Filed: May 12, 1993

[51] Int. Cl.[5] ..... C11D 11/00

[52] U.S. Cl. ..... 252/135; 252/99; 252/156; 252/173; 252/173.13; 252/174.18; 252/174.23; 252/174.24; 252/DIG. 2; 252/DIG. 14

[58] Field of Search ..... 252/135, 174.23, 174.18, 252/174.24, DIG. 2, DIG. 14, 156

[56] References Cited

U.S. PATENT DOCUMENTS 4,556,504 12/1985 Rek ..... 252/135
5,200,236 4/1993 Lang et al. ..... 427/213
5,213,706 5/1993 Rapisarda et al. ..... 252/135
5,230,822 7/1993 Kamel et al. ..... 252/174.13
5,258,132 11/1993 Kamel et al. ..... 252/94

FOREIGN PATENT DOCUMENTS 2163448 2/1986 United Kingdom .

*Primary Examiner*—Paul Lieberman
*Assistant Examiner*—A. Hertzog
*Attorney, Agent, or Firm*—A. Kate Huffman

[57] ABSTRACT

A process for preparing a concentrated detergent composition useful in automatic machine dishwashers comprising preparing a dry mixture of a thickening polymer and a sodium trimetaphosphate builder, then adding the dry blend to water and subsequently adding a potassium hydroxide base to form a homogeneous solution. Sodium silicate and optional ingredients are then added to the process. Compositions resulting from the process contain a K+/Na+ weight ratio of greater than about 0.5 to about 1 and a viscosity of from 1,800 to about 3,500 cps.

7 Claims, No Drawings

PROCESS FOR PREPARING CONCENTRATED DETERGENT COMPOSITIONS FOR USE IN AUTOMATIC DISHWASHERS

FIELD OF THE INVENTION

The present invention relates to a process for preparing concentrated detergent compositions based on builders which do not require the use of potassium salts for solubility.

BACKGROUND OF THE INVENTION

To prepare stable liquid or gel detergent formulations for automatic dishwashing machines, it is known that phosphate builders which are highly soluble and reversion stable are required. It is further known that the preparation of a homogeneous gel composition which is stable, free-flowing and readily dispensable is achieved by using sodium trimetaphosphate as the builder in combination with potassium hydroxide as an alkaline source. See Rapisarda et al., U.S. Pat. No. 5,213,706. While sodium trimetaphosphate itself is not a sequestering agent, its reaction with the base converts the metaphosphate anion to the tripolyphosphate anion.

Other bases known in the art are not desirable for the present invention because of their reaction with the metaphosphate anion. In particular, if sodium hydroxide is used for the hydrolysis, sodium tripolyphosphate which has a limited solubility, is formed. Hydrolysis with an ammonium hydroxide base will form a soluble tripolyphosphate, but due to the alkanity, ammonia is liberated, therefore, the use of ammonia hydroxide is limited to neutral or acidic formulations, rather than the alkaline compositions of the invention. Also see Rapisarda et al., U.S. Pat. No. 5,213,706.

When sodium trimetaphosphate is hydrolyzed with potassium hydroxide, according to the invention, a soluble sodium potassium tripolyphosphate (SKTP) is formed as follows:

$$(NaPO_3)_3+2\ KOH=Na_3K_2P_3O_{10}+H_2O$$

To prepare such an aqueous detergent composition, it was preferred to slurry the sodium trimetaphosphate with water in a mixing vessel and then add potassium hydroxide in solid or aqueous form. Once the builder and base are slurried into the mixing vessel, the other ingredients, including the premix were added and mixed.

It has been discovered that in compositions containing more than about 23% by weight sodium trimetaphosphate, that the traditional processing procedure results in undesirable viscosities and lumps due to large amounts of suspended solids, There is therefore a need to provide an improved process for preparing concentrated detergent compositions structured with sodium trimetaphosphate as the builder.

SUMMARY OF THE INVENTION

It is therefore an object of the present invention to provide a stable, readily dispensable concentrated detergent composition using sodium trimetaphosphate as the builder.

Another object of the invention is to provide a process to form a concentrated detergent composition which does not require the use of potassium salts to solubilize the alkaline components.

A further object is to provide a concentrated automatic dishwashing composition having a desired viscosity of between about 1,800 and 3,500 centipoises (cps).

The process of the invention comprises the steps of preparing a dry blend of a thickening polymer agent and the sodium trimetaphosphate; adding the dry blend to water to form a homogeneous dispersion; subsequently adding potassium hydroxide to form a sodium potassium tripolyphosphate; adding a sodium silicate to the formed sodium potassium tripolyphosphate to form a final concentrated detergent composition having a viscosity of about 1,800 to about 3,500 cps.

The amount of sodium trimetaphosphate present in the concentrated composition is from about 23% to about 35% by weight, The potassium hydroxide is present in an amount of about 3% to about 12% by weight with the addition of 0.1% to about 3.0% by weight of the thickening polymer. The sodium silicate is present in an amount of about 2% to about 20% by weight.

The final composition contains both sodium and potassium ions in a K+/Na+ weight ratio of greater than 0.5 to about 1 and is substantially free of added potassium salts.

DETAILED DESCRIPTION OF PREFERRED EMBODIMENTS

The process of the invention comprises the steps of:

(a) preparing a dry blend of a thickening polymer and a sodium trimetaphosphate in a ratio of about 1:8 to about 1:60;

(b) adding with agitation the dry blend of step (a) to water to obtain a homogeneous dispersion;

(c) subsequently adding from about 3% to about 12% by weight of a potassium hydroxide base to the homogeneous dispersion to form a sodium potassium tripolyphosphate solution; and (d) subsequently adding from about 2% to about 20% by weight of a sodium silicate to the sodium potassium tripolyphosphate solution to form a final composition having a viscosity of about 1,800 to about 3,500 cps and containing both sodium and potassium ions in a K+/Na+ weight ratio of greater than 0.5 to about 1. The final composition is substantially free of added potassium salts.

The sodium trimetaphosphate used in the process is preferably from about 23% to about 35% by weight, more preferably about 23% to about 30% by weight of the composition.

Preferably, the sodium trimetaphosphate is used in a powder form. Suitable sources of the builder include Monsanto Chemical Co. of St. Louis, Miss.

Thickeners useful in the compositions of the invention include cross-linked polymers having molecular weights ranging from about 500,000 to about 10,000,000, preferably between 500,000 and 4,000,000. Examples of suitable commercially available cross-linked polymers are Polygel DA supplied by 3V Chemical Corp. of Weehawken, N.J. Other suitable polymers include the Carpobol® resins manufactured by the B. F. Goodrich Chemical Co. of Cleveland, Ohio and include Carpobol 941® (M.W. 1,250,000); Carpobol 934® (M.W. 3,000,000); Carpobol 940® (M.W. 4,000,000); and Carpobol 617® (M.W. 4,000,000). Analogs provided by other manufacturers would also be useful.

Other suitable thickeners useful in the invention are disclosed in U.S. Pat. No. 4,836,948 (Corring) enclosed herein incorporated by reference.

The thickening polymer is present in the compositions in a range of 0.1% to about 3.0% by weight, preferably about 0.4% to about 1.5% by weight.

It is essential that the selected polymer thickener be dry blended with the sodium trimetaphosphate builder in the first step in a ratio of about 1:8 to about 1:60, preferably about 1:12 to about 1:25, to obtain a dry blend. In contrast to the previous method of slurrying the builder with water and then adding the base, the inventive method requires that the thickening polymer and the builder be dry blended, added to water and then add the base in order to obtain a complete dispersion of the alkaline ingredients.

Without being limited by theory, the subsequent addition of the potassium hydroxide to the aqueous mixture of polymer and builder swells and hydrates the polymer at the same time the sodium potassium tripolyphosphate is formed. The resulting solution is a complete dispersion of the alkaline ingredients. The increase of the sodium to the solution by the subsequent addition of the sodium silicate forms small crystals of sodium potassium tripolyphosphate; however, the crystals beneficially increase viscosity by their interaction with the polymer of the resulting compositions having a desired range of about 1,800 to about 3,500 cps., preferably 1,900 to 3,100 cps.

The inventive process drastically reduces the processing time to about one-quarter to that of the prior art process requiring a mixture of the slurried builder and base.

Alkaline metal silicates are employed as cleaning ingredients, as the source of alkalinity, metal corrosion inhibitor and protector of overglaze on china tableware. An especially preferred silicate is sodium silicate having a ratio of SiO2:Na2O of from 1.0 to about 3.3, preferably from about 2 to about 3.2. While potassium silicate may be used in detergent formulations to provide an additional source of potassium ion, sodium silicate is preferred since it was more effective. Sodium silicate is used in the invention in either solid or aqueous form at a level in the range of about 2% to about 20%, more preferably from about 3% to about 15%.

Nonionic surfactants are generally preferred for use of automatic dishwasher detergents. Preferably, they should be of the defoaming type.

Where appropriate, they can be used in an amount of from about 0.2% to about 8%, preferably from about 1% to about 4%. Nonionic synthetic detergents can be broadly defined as compounds produced by the condensation of alkylene oxide groups with an organic hydrophobic compound which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Examples of the various chemical types suitable as nonionic surfactants include: polyoxyethylene and/or polyoxypropylene condensates of aliphatic carboxylic acids, aliphatic alcohols and alkyl phenols; polyoxyethylene derivatives of sorbitan mono -,di-, and tri-fatty acid esters and polyoxyethylene - polyoxypropylene block polymers as described in U.S. Pat. No. 4,973,419, herein incorporated by reference.

The incompatibility of many alkoxylated nonionics with chlorine bleach must be taken into consideration when liquid and gel compositions are formulated. Attempts have been made to improve compatibility of alkoxylated nonionics and chlorine bleach by "capping" the terminal hydroxyl group, as described in U.S. Pat. Nos. 4,859,358 (Gabriel), 4,988,456 (Takahashi) herein incorporated by reference.

Two alternative means of compatibilizing alkoxylates and chlorine bleach are: (1) to separate them in different compartments within a container for storage, and provide a means to combine them when they are dispensed for use, or (2) to encapsulate one of the materials. Encapsulation of chlorine bleach is preferably used in the present invention and is described more fully in the section on bleaches.

Since the nonionic is compatible with chlorine bleach in this invention, a wide variety of alkoxylates may be used. Particularly preferred are the defoaming nonionics such as those given in U.S. Pat. No. 4,973,419 in column 6, lines 28–50, herein incorporated by reference.

Bleach

A wide variety of halogen and peroxygen bleach sources may be used in the present invention. Examples of such halogen and peroxygen bleaches are described in U.S. Pat. No. 4,973,419 columns 4, and 5 herein incorporated by reference.

However, the bleach sources preferred for use in the present invention are those which can be encapsulated by the processes disclosed in U.S. Pat. No. 5,230,822 (Kamel et al.) and U.S. Pat. No. 5,200,236 (Lang et al.) herein incorporated by reference. Particularly preferred chlorine bleach sources include potassium, and sodium dichloroisocyanurate dihydrate. They should be present at a level which provides about 0.2% to about 1.5% available chlorine. Hypohalite liberating compounds may also be employed in the inventive dishwashing detergents at a level of from 0.5% to 5% by weight, preferably from 0.5% to 3%.

Co-structurants or stabilizers may also be used in combination with the thickening polymers. Examples of such preferred co-structurants and stabilizers include (1) alumina described in U.S. Pat. No. 4,836,948, (2) alkali metal silica aluminate described in U.S. Pat. No. 4,941,988, (3) polyvalent metal soaps, described in U.S. Pat. No. 4,752,409 (Drapier, et al.) and (4) a synthetic hectorite clay such as Laponite XLS supplied by Waverly Mineral Products Co., subsidiary of LaPorte, Inc., of Bala Cynwd, Pa. 19004.

Preferred co-structurants include alumina and the hectorite clays. The constructurants may be used in a range of from about 0.005% to 1%; preferably about 0.01% to about 0.5%; and especially preferred about 0.01% to about 0.1%.

Bleach stable colorants such as Direct Yellow 28 and others disclosed in U.S. Pat. No. 5,069,162 may be used in the present invention. Bleach sensitive dyes such as those described in U.S. Pat. No. 4,464,281 (Rapisarda et al.) may also be used in the preferred embodiments containing encapsulated bleach. Alternatively, pigments such as Ultramarine Blue 5151 or Ultramarine Blue 17 may also be used. Greater latitude in the selection of perfume ingredients is provided because destabilization by chlorine is not a factor. If additional defoaming is desired, silicones such as a polydimethyl siloxane with 6% hydrophobed silica supplied as Antifoam DB- 100® by Dow Corning of Midland, Mich. may be used.

Enzymes may also be included in the formulations. Enzymes such as amylases, proteases and lipases, if present, are used in an amount up to about 1%, preferably about 0.6%.

Minor amounts of other ingredients such as anti-tarnish agents, soil suspending agents, hydrotropes, preservatives etc. may also be included in the inventive formulations. The amount of each optional additive is no greater than about 0.5% by weight.

The following examples will serve to distinguish this invention from the prior art, and illustrate its embodiments more fully. Unless otherwise indicated, all parts, percentages and proportions referred to are by weight.

EXAMPLE 1

The following composition containing sodium tripolyphosphate was prepared by a prior art process as follows:

| COMPONENT | PERCENT ACTIVE |
|---|---|
| Laponite XLS[1] | 0.02 |
| Yellow Dye #28 (5%) | 0.003 |
| Sulfuric Acid Concentrate | 0.01 |
| Polygel DA[2] | 0.6 |
| Ru Silicate 2.4r (47.1% solids) | 10 |
| Sodium Tripolyphosphate | 24.0 |
| Sodium Hydroxide (50%) | 1.4 |
| Polytergent SLF-18[3] | 2.0 |
| Perfume | 0.1 |
| Parafin Wax Encapsulates of Clearon CDB56[4] | 2.7 |
| Water QS | to 100 |

[1]A smectite clay supplied by LaPorte Industries of Rolling Hills, Illinois
[2]A cross-linked polymer, M.W.~4,000,000 supplied by 3V Chemical Co. of Weehawken, New Jersey
[3]A nonionic surfactant supplied by Olin Chemical Co. of Hartford, Connecticut
[4]A sodium dichloroisocyanurate dihydrate supplied under the trademark CDB56 by Olin Chemical Co. of Hartford, Connecticut. The CDB56 is encapsulated as described in U.S. Pat. No. 5,200,236 (Lang et al.) herein incorporated by reference.

A polymer premix was prepared by adding the Polygel DA at a speed of 300 rpm to 600 rpm to a mixture of the water, the laponite, the direct yellow #28 and the sulfuric acid concentrate with maximum agitation. Mixing was continued until the premix was smooth and homogeneous. Homogeneous is defined as the absence of lumps or aggregates. The total mixing time was one hour.

A main mix was prepared in a separate vessel by combining the remaining water, the silicate and the sodium hydroxide. The phosphate was added slowly to this mixture and mixed until fully dispersed and hydrated for one hour.

The polymer premix was then added to the main mix and mixing was continued until the dispersion was homogeneous for a mixing time of 30 minutes.

The remaining components were added to the batch.

The viscosity of the product taken about 20 seconds after the mixture of the polymer premix and the main mix was about 7,500 cps., a viscosity too high to feasibly process the product on a production scale.

EXAMPLE 2

Variations of the composition of Example I were prepared according to the process described in Example 1. The Polygel DA was reduced from 0.6% to 0.5% and the sodium silicate was reduced from 10.0% to 8.0%. The viscosity of the resulting composition was still about 7,000 cps. and syneresis or separation was also observed.

EXAMPLE 3

The following composition was prepared:

| COMPONENTS | PERCENT ACTIVE |
|---|---|
| Laponite XLS[1] | 0.02 |
| Direct Yellow #28 (5%) | 0.003 |
| Sulfuric Acid Concentrate | 0.01 |
| Polygel DA[2] | 0.7 |
| Sodium Trimetaphosphate | 26.6 |
| Potassium Hydroxide (45%) | 11.7 |
| Britesil $H_2O$ (81%)[3] | 8.0 |
| Polytergent SLF-18[4] | 2.5 |
| Perfume | 0.1 |
| Parafin Wax Encapsulates of Clearon CDB56[5] | 4.68 |
| Water QS | to 100 |

[1]A smectite clay supplied by LaPorte Industries of Rolling Hills, Illinois
[2]A cross-linked polymer, M.W.~4,000,000 supplied by 3V Chemical Co. of Weehawken, New Jersey
[3]A sodium silicate of 2.0r supplied by P.Q. Corp of Valley Forge, Pennsylvania
[4]A nonionic surfactant supplied by Olin Chemical Co. of Hartford, Connecticut
[5]A sodium dichloroisocyanurate dihydrate supplied under the trademark CDB56 by Olin Chemical Co. of Hartford, Connecticut. The CDB56 is encapsulated as described in U.S. Pat. No. 5,200,236 (Lang et al.) herein incorporated by reference.

The foregoing formulation was prepared as described in Example I by the prior art method of forming a polymer premix. It is noted that the sodium trimetaphosphate of Example 3 was substituted for the sodium tripolyphosphate of Example I to reduce the amount of suspended solids in the finished composition.

As described in Example 1, the main mix was prepared in a separate vessel by dispersing the sodium trimetaphosphate in water. Potassium hydroxide was added and reacted with the sodium trimetaphosphate to form the mixed sodium potassium tripolyphosphate. Mixing continued until a temperature rise of 50° C. was achieved and all solids were dissolved.

The granular sodium silicate (Britesil H2O) was added next to the main mixture with mixing for 18 hours. Additional heat was applied when it was observed that it was not possible to completely dissolve the silicate even after the long mixing point. It is further noted that granular sodium silicate was added rather than aqueous silicate because there is insufficient room in the formulation for an aqueous silicate.

The polymer premix was than added to the main mix as in Example I and mixed for another three hours. The resulting product contained lumps of undissolved silicate. The viscosity of the final product was also unacceptably high.

Subsequent processes involving the reduction of the Polygel DA polymer from 0.7 to as low as 0.5% did not reduce the viscosity of the resulting composition.

EXAMPLE 4

The following composition was prepared as follows:

| COMPONENT | PERCENT ACTIVE |
|---|---|
| Laponite XLS[1] | 0.02 |
| Direct Yellow #28 (5%) | 0.003 |
| Sulfuric Acid Concentrate | 0.01 |
| Polygel DA[2] | 0.7 |
| Sodium Potassium Tripolyphosphate | 34.8 |
| Potassium Hydroxide (45%) | 1.7 |
| Ru Silicate 2.4r (47.1% solids) | 8.0 |
| Polytergent SLF-18[3] | 2.7 |
| Perfume | 0.1 |

-continued

| COMPONENT | PERCENT ACTIVE |
|---|---|
| Parafin Wax Encapsulates of Clearon CDB56[4] | 4.68 |
| Water QS | to 100 |

[1]A smectite clay supplied by LaPorte Industries of Rolling Hills, Illinois
[2]A cross-linked polymer, M.W.~4,000,000 supplied by 3V Chemical Co. of Weehawken, New Jersey
[3]A nonionic surfactant supplied by Olin Chemical Co. of Hartford, Connecticut
[4]A sodium dichloroisocyanurate dihydrate supplied under the trademark CDB56 by Olin Chemical Co. of Harfford, Connecticut. The CDB56 is encapsulated as described in U.S. Pat. No. 5,200,236 (Lang et al.) herein incorporated by reference.

It is noted that the sodium potassium tripolyphosphate of the above formula was in granular form and equal in percent by weight of the composition of the sodium trimetaphosphate (26.6%) of Example 3. Adding the sodium potassium tripolyphosphate in granular form increases the amount of free water available in the composition and allows the use of aqueous silicate in the attempt to improve solubility, reduce suspended solids and reduce the viscosity of the final composition.

A polymer premix was prepared as described in Example 1 and 3.

The sodium potassium tripolyphosphate was added to the water and mixed for more than eight hours. Additional heating was applied when it was observed that the builder did not completely dissolve.

The remaining ingredients were added as described in Example I above.

The final composition had a viscosity of 11,500 cps. at 17.7/seconds following the addition of the polymer premix to the main mix. This composition not only had an undesirably high viscosity, but also contained large lumps of undispersed phosphate builder.

EXAMPLE 5

The following composition was prepared according to the process of the invention:

| COMPONENT | PERCENT ACTIVE |
|---|---|
| Laponite XLS[1] | 0.02 |
| Direct Yellow #28 (5%) | 0.003 |
| Sodium Trimetaphosphate | 26.6 |
| Polygel DA[2] | 0.6 |
| Potassium Hydroxide (45%) | 11.7 |
| Ru Silicate 2.4r (47.1% solids) | 8.0 |
| Polytergent SLF-18[3] | 2.7 |
| Perfume | 0.1 |
| Parafin Wax Encapsulates of Clearon CDB56[4] | 4.68 |
| Water QS | to 100 |

[1]A smectite clay supplied by LaPorte Industries of Rolling Hills, Illinois
[2]A cross-linked polymer, M.W.~4,000,000 supplied by 3V Chemical Co. of Weehawken, New Jersey
[3]A nonionic surfactant supplied by Olin Chemical Co. of Hartford, Connecticut
[4]A sodium dichloroisocyanurate dihydrate supplied under the trademark CDB56 by Olin Chemical Co. of Hartford, Connecticut. The CDB56 is encapsulated as described in U.S. Pat. No. 5,200,236 (Lang et al.) herein incorporated by reference.

The 6% polygel DA polymer was dry blended with 100 grams of sodium trimetaphosphate to form a dry blend. This dry blend was then added to a vessel containing the laponite, the yellow dye and the water to achieve a homogeneous dispersion after only about ten minutes of agitation.

Subsequently, the potassium hydroxide was added to the homogeneous dispersion to form a homogeneous solution. The sodium silicate was added with mixing at 300 rpm to 600 rpm speed. The remaining ingredients (e.g. nonionic surfactats, perfume) were then added.

The initial viscosity of the finished product was 1,900 cps.

Mixing times adding up to 30 minutes.

By preparing a dry blend of the polymer and builder, rather than a polymer premix as in the prior art, a concentrated product with a desired viscosity could be obtained in a commercially feasible mixing time.

We claim:

1. A process for preparing a concentrated detergent composition comprising the following steps sequentially:

a. preparing a dry blend of a thickening polymer and sodium trimetaphosphate in a ratio of about 1:8 to about 1:60, wherein the sodium trimetaphosphate is present in an amount of from about 23% to about 35% by weight based on total composition;

mixing the dry blend into water to form a homogeneous dispersion;

c. subsequently adding from about 3% to about 12% by weight of a potassium hydroxide base to form sodium potassium tripolyphosphate;

d. adding about 2% to about 20% by weight of a sodium silicate to the solution of step (c); and adding about 0.2% to about 8% by weight of a nonionic surfactant;

f. mixing one or more optional additives selected from the group consisting of perfumes, dyes, pigments, preservatives, the amount of each additive being up to 0.5% by weight, wherein the resulting composition contains both sodium and potassium ions in a $K^+/Na^+$ weight ratio of greater than 0.5 to about 1, is substantially free of added potassium salts, and has a viscosity of about 1,800 to about 3,500 centipoises.

2. A process according to claim 1 wherein the sodium trimetaphosphate of step (a) is present in an amount of about 23% to about 30% by weight.

3. A process according to claim 1, wherein the thickening polymer has a molecular weight of between 500,000 and 4,000,000.

4. A process according to claim 1 wherein step (d) further comprises adding the sodium silicate in aqueous form.

5. A process according to claim 1, wherein the composition further comprises an effective amount of an encapsulated bleach source.

6. A process according to claim 5, wherein the bleach source is an effective amount of a halogen or peroxygen source.

7. A process according to claim 6 wherein the halogen source provides about 0.2% to about 1.5% chlorine.

* * * * *